US005622672A

United States Patent [19]

Swick et al.

[11] Patent Number: 5,622,672

[45] Date of Patent: Apr. 22, 1997

[54] IGNITION OF THERMAL LANCE AND MEANS AND METHOD FOR USE THEREWITH AND THEREFOR

[75] Inventors: Robert H. Swick, Wilmington, Del.; Russell H. C. Howe-Smith, Wayne, Pa.; David P. Dillard, New Castle, Del.; L. Stephen Bowers, Wettown, Pa.

[73] Assignee: Alloy Surfaces Co., Del.

[21] Appl. No.: 410,070

[22] Filed: Mar. 24, 1995

[51] Int. Cl.[6] ..... B23K 7/00

[52] U.S. Cl. ..... 266/48; 431/99

[58] Field of Search ..... 266/48; 431/99, 431/268; 110/349

[56] References Cited

U.S. PATENT DOCUMENTS

| | | | |
|---|---|---|---|
| 3,570,419 | 3/1971 | Brandenberger | 431/99 |
| 3,738,288 | 6/1973 | Brandenberger | 431/99 |
| 3,921,542 | 11/1975 | Brandenberger | 431/99 |
| 4,477,060 | 10/1984 | Molinder | 266/48 |
| 4,915,618 | 4/1990 | Brandin | 266/48 |

*Primary Examiner*—Scott Kastler
*Attorney, Agent, or Firm*—Connolly & Hutz

[57] ABSTRACT

Solid-fueled torches, wherein the metallic material of a thermal lance provides the solid fuel for the torch flame, are ignited by a substantially self-contained igniter not requiring any source of electrical energy. These torches are particularly well-suited for specialized types of manual on-site cutting or welding. The igniter is designed to be activated by sudden exposure of a pyrophoric material (disposed within the sealed interior of the igniter) to a flow of substantially pure oxygen. The igniter can be either pre-attached to an ignitable tip of the thermal lance, followed by activation (the oxygen gas flows through the interior of the lance), or simply placed on a firm surface so that an ignitable tip of the thermal lance can be used to break the seal on the igniter and thereby introduce the flow of oxygen into the interior of the igniter.

20 Claims, 5 Drawing Sheets

155
153
157
140
143
161

88

89
83
87

89
83
87

151
167
163
162
155
153
130
157
140
141
143
139
137
135
136
133
132
131
$O_2$ 163
169
159
162
151
167
155
165
153

193
189
191
182
181
167
155
165
153

140
157
145
148

142
157
143
147
149

IGNITION OF THERMAL LANCE AND MEANS AND METHOD FOR USE THEREWITH AND THEREFOR

FIELD OF THE INVENTION

This invention relates generally to the ignition of solid-fueled torches wherein the metallic material of a thermal lance provides the solid fuel for the torch flame. An aspect of this invention relates to an igniter or specialized ignition device used to heat the thermal lance to its ignition temperature. Another aspect of this invention relates to means and methods for the ignition of metallic thermal lances used in specialized types of manual on-site cutting or welding. Still another aspect of this invention relates to a cutting or welding torch comprising, in combination, a cutting or welding rod or thermal lance and an attached (but replaceable) ignition device for providing a temperature high enough to ignite the tip of the rod or lance.

DESCRIPTION OF THE PRIOR ART

Welding and cutting devices traditionally make use of either electrical energy in some form (e.g. resistance heat or an electric arc) or a torch flame produced by combustion of a gaseous fuel (acetylene, hydrogen, lower alkanes, natural gas, etc.) to provide temperatures high enough to melt a variety of metals, particularly ferrous metals. But there are specialized applications of welding and cutting (particularly the cutting of steel and concrete) where a torch flame is obtained through the ignition and sustained rapid oxidation of a metallic substance such as a ferrous metal, using substantially pure oxygen as the oxidizer. For example, a hollow steel rod attached at one end to the oxygen supply (the hollow rod is typically called a "thermal lance", perhaps by analogy to the lances used in steelmaking) can be ignited by means of an electrical or chemical igniter or ignition cap held against the free end of the rod or lance. See, for example, U.S. Pat. No. 4,477,060 (Molinder), issued Oct. 16, 1984.

Anyone who understands why sparks fly from a steel tool held against a grinding wheel is familiar with the fact that transition metals (as well as light metals such as magnesium, aluminum, etc.) can burn, but most transition metals burn rapidly and vigorously only with the aid of strong oxidizers such as substantially pure gaseous oxygen, while light metals such as magnesium can sustain rapid combustion in air (which is only about 20 volume-% oxygen). In the specialized on-site manual cutting tasks described above, the actuation of the igniter and the flow of substantially pure oxygen heat the free end of the thermal lance up to a temperature at which the free end begins to burn, so that the ferrous metal of the lance becomes the fuel, so to speak, for the torch flame at the free end. So long as the flow of substantially pure oxygen to the free end of the lance continues, the lance will continue to burn, but cessation of the flow of oxygen typically extinguishes the lance, due to the inability of the ferrous metal to sustain combustion in air.

An objective of the burning-lance technique is to provide a cutting tool for manual, on-site tasks in which the equipment should be small, lightweight, compact, and as self-contained as possible, hence very portable. (Less preferably, a burning lance can be used in welding.) Examples of such on-site cutting tasks include quick rescue (e.g., freeing an occupant trapped in a severely damaged automobile), cutting up metallic scrap in a scrap yard or dump yard, or in underwater salvage operations. In line with this objective, wholly non-electric (e.g. chemical) igniters have advantages over those in which an electrical impulse is used to detonate a charge which in turn ignites the end of the lance. The electrical energy for a charge detonation impulse used in the prior art is typically provided by a heavy, cumbersome electric storage battery (accumulator).

The need for a heavy, cumbersome battery is particularly troublesome in underwater welding and cutting tasks, where portability is a desirable characteristic of the welding or cutting system and independence from surface-based equipment or power sources is desired. Moreover, the underwater use of the electric detonation impulse can be hazardous.

It has been suggested that ignition of a thermal lance can be achieved with an igniter, coupled to the free end of the lance, that receives some part of the flow of pressurized oxygen and that combines a friction-producing means, a primer, and a priming composition. See U.S. Pat. No. 4,915,618 (Brandin), issued Apr. 10, 1990. Compositions which produce intense heat by means of chemical reactions, heat and/or friction, a sharp increase in pressure (like a blow or concussion), or the like are of course well known, but safety, simplicity, reliability, and environmental compatibility are just four of the factors that should be taken into account when designing ignition devices based on any of these principles. Moreover, to provide any significant advantage over igniters actuated electrically, such ignition devices should be substantially self-contained, independent devices (i.e. attachable to/replaceable on the end of the lance), so that, if the lance is extinguished, a new igniter can be put in place and the lance re-ignited.

Accordingly, this invention contemplates an attachable/detachable non-electrical ignition device that can be detachably placed on the end of a thermal lance or cutting rod, that can achieve the design objectives mentioned above, and that will not detract from the advantages of small size, compactness, a high degree of portability, and independence from remote sources of energy or the like.

SUMMARY OF THE INVENTION

In principle, this invention contemplates combining a thermal lance (i.e. a metal cutting rod or torch) with a substantially self-contained ignition device or igniter which requires no electrical impulse for actuation. (The ignition device or igniter is structurally self-contained and is operationally or functionally self-contained except for the oxygen source attached to the lance; a handle or fixture to hold the lance (if desired), and a means for applying a hard blow or the like to its free end or a generally flat surface on which to place the igniter.) One end of the hollow lance is constructed and arranged to engage an oxygen hose or oxygen torch in a gas-tight manner and receive a flow of substantially pure oxygen under pressure. The igniter is attached to the opposite end (hereafter the "free end" or the "ignition end") of the hollow lance. The igniter has a sealed-off, oxygen-impermeable interior containing a pyrophoric material; this interior of the igniter is sealed off from its surroundings by an oxygen-impermeable membrane or foil. When the igniter/lance combination is grasped at its oxygen-receiving end, and the free end is struck with a hard object or pressed sharply or struck against a hard, immovable surface, a membrane penetration device (which is preferably integral with ignition end of the lance—for example, the ignition end can have a pointed profile or piercing face which can act like a piercing tool), also within the igniter housing, is forced into contact with the membrane and quickly pierces through it, thereby exposing the pyrophoric material to the flow of substantially pure oxygen supplied to the lance. To prevent accidental or premature rupture of the membrane, a removable safety barrier (e.g. a pin or a protective cover) prevents contact between the membrane penetration device (e.g. the ignition end of the lance, provided with a sharpened profile) and the membrane. The igniter cannot be activated, even by a very sharp blow, so long as the barrier is in place.

This invention also contemplates a substantially self-contained igniter constructed and arranged to be attached to the free end of a thermal lance. In one embodiment of the igniter, the protective barrier means is a removable pin; in another embodiment, the protective barrier is a removable, rupture-resistant cover or cap.

BRIEF DESCRIPTION OF THE DRAWING

In the accompanying Drawing, wherein like numerals denote like parts in the various views of the combined device and its various subcombinations.

DETAILED DESCRIPTION OF THE PREFERRED EMBODIMENTS

Figure 1:
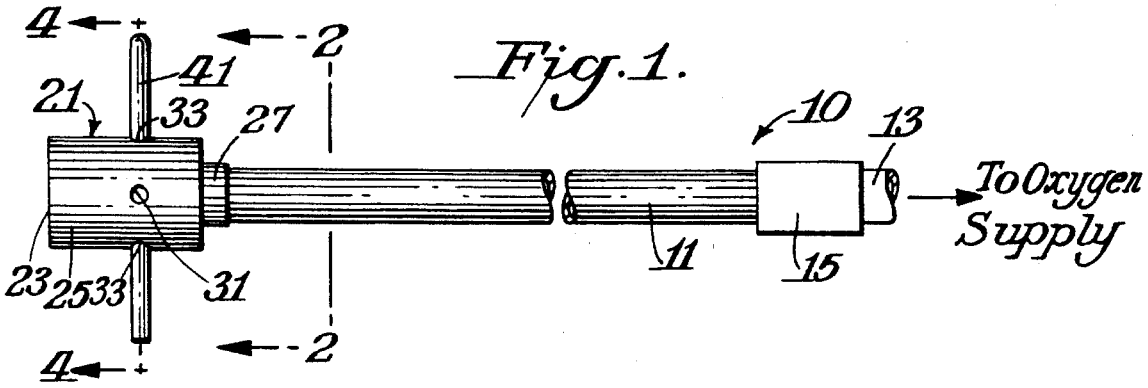
FIG. 1 is a side-elevational view of a hollow lance/igniter combination of this invention.

As indicated previously, the igniter/lance combination makes use of substantially pure oxygen which enters the hollow lance at one end (the oxygen-receiving end) and flows toward the igniter device attached at the ignition end of the lance. By "substantially pure" oxygen is meant oxygen with a degree of purity at least equal to (but not necessarily exceeding) the lowest industrial grades of oxygen, including oxygen obtained by liquefaction of air and selective distillation of the liquid nitrogen. Such industrial grades of oxygen can still contain traces of nitrogen or other gases, but small amounts of nitrogen or the like in the oxygen stream fed to the end of the lance do not detract from the objectives of this invention, so long as the oxygen stream is sufficiently pure to sustain combustion of a transition metal or alloy such as iron or steel.

To bring about as rapid a rise in temperature as possible upon activating the igniter, the igniter housing and the penetration means are constructed and arranged to provide maximum flow-through of the substantially pure oxygen gas entering the hollow lance from the oxygen-receiving end of the combination. Thus, the igniter housing is provided with carefully placed vent ports, and the penetration device is provided with a passageway for the oxygen. The vent ports and the passageway insure that the exposed pyrophoric material will have an oxygen supply adequate for the purposes of this invention. To simplify the design, venting can be provided, at least in part, when the aforementioned barrier is removed from the igniter housing.

The two major components of the aforementioned combination (i.e. the igniter and the hollow lance) can both comprise metal. The hollow thermal lance can be of a conventional design and preferably comprises a transition metal or transition metal alloy such as a ferrous metal (typically iron or steel, most preferably a low-grade steel such as carbon-steel). Because thermal lances are used as solid fuels and are consumed during operation of the lance as a cutting or welding torch, it is desirable that the metal used to make the lance be inexpensive. It is also desirable that the burning thermal lance metal be an easily extinguishable transition metal, both to insure safer use and to save a portion of the lance for later use, in the event that the cutting task is completed without consuming the entire lance. Light metals (metals of Groups IA, IIA, and IIIA of the Periodic Table), even relatively inexpensive light metals such as aluminum and magnesium are therefore typically not used in thermal lances. For similar reasons, rare earths and rare earth alloys such as cerium or cerium-iron alloys are generally undesirable for use in thermal lances.

The igniter, on the other hand, is intended to be fully consumed by flame and need not be extinguishable. Elements of the igniter such as the oxygen-impermeable container for the pyrophoric material (including the membrane which seals this container) and even the igniter housing can, if desired, comprise an organic or, more typically, an inorganic material that is more easily ignited than steel, e.g. a light metal or metal alloy such as aluminum or magnesium. The use of light metals in the structure of the igniter can enhance its ability to ignite the lance. Alternatively, the igniter can also comprise a low-grade steel or other transition metal alloy.

The membrane that seals the oxygen-impermeable container for the pyrophoric material preferably comprises a metal foil which is thin enough to be pierced fairly easily by a cutting tool.

In principle, the hollow thermal lance used in this invention not only serves to provide a torch flame at its ignition end or tip, it also functions like a piston which drives the penetration means quickly and forcefully into the membrane after the barrier means has been removed. Because the membrane is ruptured quickly and forcefully, and because the substantially pure oxygen comes into intimate contact with the mass of pyrophoric material, but because neither of these events can occur without removal of the barrier means, ignition is attained by chemical and physical (i.e. non-electrical) means in a manner that is safe, simple, reliable, and free from the production of toxic byproducts. The igniter can expose the burning end of the thermal lance by becoming completely consumed in flames, but more typically it drops off before being fully consumed. When the cutting (or welding) task is completed, the oxygen supply can be shut off, and the thermal lance will cease to burn. Alternatively, a relatively short lance can be used which is fully consumed by the time the task is completed. To resume cutting or welding at a later time, the ignition end of the original lance (or a replacement lance) can be inserted into a second igniter, the oxygen supply can be turned back on, and the second igniter can be actuated in the same manner as the first. Thus, to carry out a plurality of tasks, the torch operator need only carry with him the lance (or a plurality of relatively short lances), the oxygen supply, and a supply of igniters. The igniters are so small and compact that several can be conveniently carried by the torch operator. In one embodiment of the invention, the igniter is attached to the lance before the pyrophoric material in the igniter is exposed to substantially pure oxygen. In another embodiment of the invention, the igniter is used in combination with the lance, in the manner generally indicated above, but the ignition end of the lance is not inserted into the igniter assembly until the membrane sealing off the pyrophoric material from the atmosphere has been ruptured.

The pre-attachable embodiment of the igniter is optionally provided with an adapter fitting, typically a dual-size fitting, which enables one to connect the body (shell or housing) of the igniter to lances of various external diameters. Protrusions or bosses within the interior of this adapter fitting tightly engage the ignition end of the lance, holding the igniter in place for impact ignition.

The thermal lance can be a hollow rod of, say, 5 mm to 30 mm outside diameter and can be almost any desired length, i.e. almost any desired burn time, ranging from about 10 seconds (10 to 15 cm in length) to a minute or two of burn time, depending on the rate of oxygen flow). Since an igniter of this invention is attachable and detachable in the field or even, with a properly designed lance, under water, the lance/igniter combination need not be pre-assembled and the length of the lance need not be pre-determined. For one-shot cutting tasks of short duration, the thermal lance can be as short as 15 to about 30 cm, and for more time-consuming tasks or for a plurality of tasks, the lance can be as much as 90 or 100 cm in length or even longer. Use of the igniter or the igniter/lance combination in the field or under water is thus made highly convenient and practical, and such use is environmentally friendly, since it creates no harmful byproducts.

Figure 2:
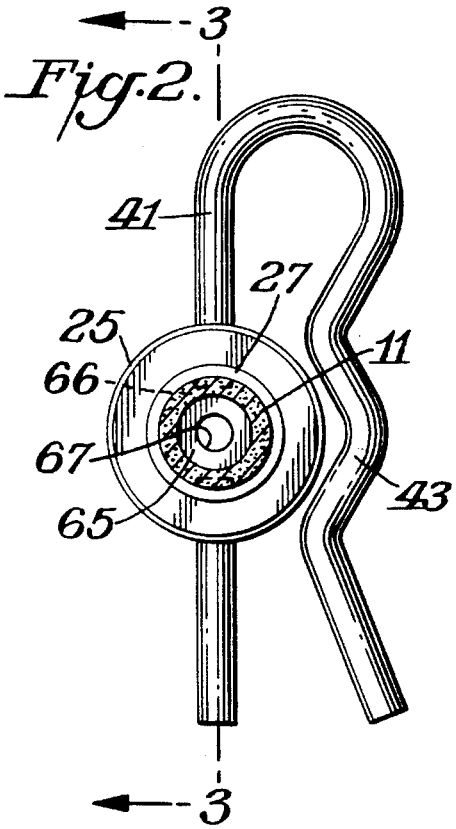
FIG. 2 is a cross-sectional rear elevational view taken along line 2—2 of FIG. 1.
Figure 3:
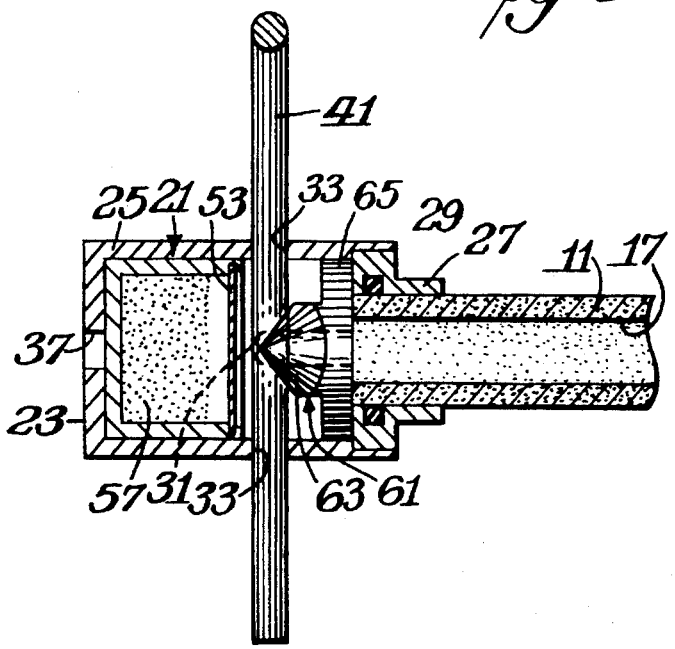
FIG. 3 is a cross-sectional side elevational view taken along line 3—3 of FIG. 2.
Figure 4:
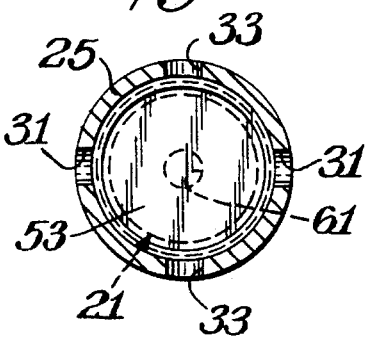
FIG. 4 is a cross-sectional rear elevational view taken along line 4—4 of FIG. 1 showing a cross-sectional view of the igniter housing with the barrier means (pin) removed.
Figure 5:
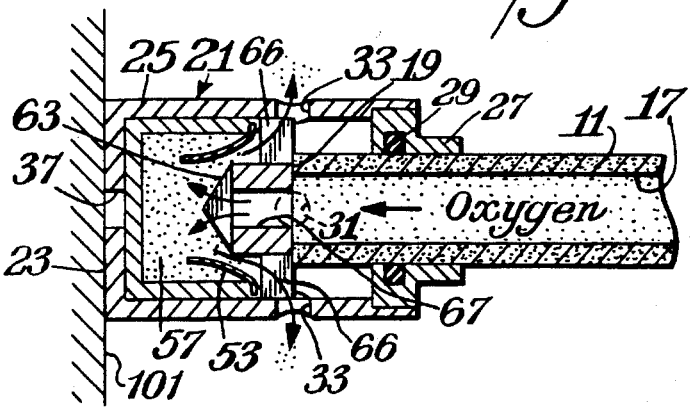
FIG. 5 is a side elevational view similar to FIG. 3, also showing the barrier means removed and showing the membrane penetration means in ignition position.
Figure 7:
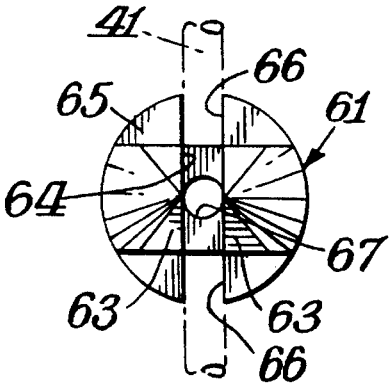
FIG. 7 is a front elevational view of the membrane penetration means shown in FIG. 6.
Figure 8:
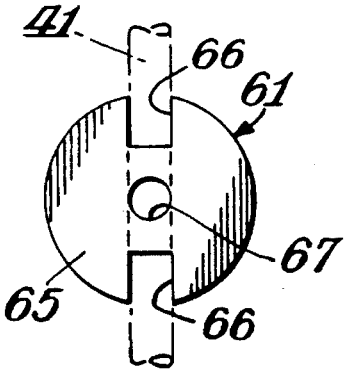
FIG. 8 is a rear elevational view of the membrane penetration means shown in FIGS. 6 and 7.
Figure 9:
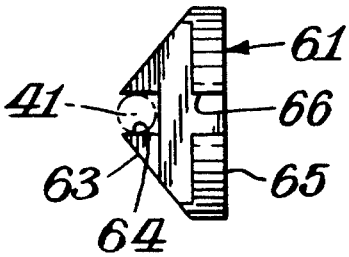
FIG. 9 is a bottom plan view of the membrane penetration means shown in FIGS. 6 to 8.

Turning now to the Drawing, wherein like reference numerals denote like parts in the various views, FIGS. 1 to 3 illustrate a preferred embodiment of the lance/igniter combination 10 of this invention, wherein the moveable elements of combination 10 are in their original or non-actuated position. The details of the one of the moveable elements (the membrane penetration means or striker 61) are shown in FIGS. 7 to 9, and in these Figures the original position of the barrier means or cotter pin 41 is shown in phantom. FIG. 4 illustrates a portion of the igniter with the cotter pin 41 removed, and FIG. 5 illustrates moveable elements of combination 10 in their actuated or ignition position; in order to obtain this ignition position, of course, cotter pin 41 must have first been removed.

Considering first the original or non-actuated position of the moving parts shown in FIGS. 1 to 3, it will be readily apparent from FIG. 1 that the fully assembled combination 10 comprises a hollow rod or thermal lance 11, preferably generally cylindrical in shape that snugly engages attachable/detachable ignition device or igniter 21. The igniter comprises, inter alia, a generally cylindrical housing 25 and a metal fitting 27 of generally circular cross-section extending outward from the housing 25. The oxygen-receiving end of lance 11 cannot be seen because it is engaged in the usual hose connector or fitting 15 attached to the oxygen hose 13. Fitting 15 provides a gas-tight engagement so that the substantially pure oxygen provided under pressure by the oxygen supply (not shown) will be confined to the elongated space 17 defined by lance 11 and will flow through elongated space 17 and into the interior of igniter 21. The oxygen supply is preferably a portable, pressurized tank and can be of any appropriate conventional design. Typical oxygen tank pressures and the like are described below.

A slidable gas-tight engagement between lance 11, at and near its ignition end 19 (FIG. 3), and the igniter 21 is provided by the metal fitting 27 and optionally an O-ring 29 that, together, insure a snug, gas-tight frictional engagement while at the same time permitting lance 11 to be disengaged, if use of the lance is to be postponed, or to be plunged deeply into the interior of igniter 21 like a piston inside a cylinder. The head, so to speak, of this piston-like arrangement is penetration means or striker 61 (FIG. 3), which comprises a retainer disc 65 (FIGS. 2 and 3) and cone-shaped piercing tool or awl 63 (FIG. 3). For ease of disassembly or disengagement of combination 10 the "piston rod" (lance 11) is not integral with the "head" (penetration means or striker 61), but merely abuts it. Nevertheless, in operation lance 11 and striker 61 co-operate as if they were integral when lance 11 drives striker 61 deep into the interior of igniter 21 and thereby activates igniter 21.

It will be apparent from FIGS. 2 and 3 that striker 61 cannot be forced any further into the interior of igniter 21 so long as cotter pin 41 is in place in its original position (FIGS. 2 and 3). Indeed, with pin 41 in place, striker 61 will remain in the position shown in FIG. 3 even if the entire combination 10 were dropped onto a hard surface or otherwise subjected to a sharp blow or concussion. Accordingly, the sealed container 51 for the pyrophoric material 57—which container 51 comprises a cup whose open side is sealed off with an air-tight membrane 53—remains sealed without possibility of loss of air-tight integrity until cotter pin 41 has been removed, allowing the lance to puncture the airtight membrane.

Container 51, like housing 25 has a generally circular cross-section and fits snugly and in a substantially air-tight manner into the interior of igniter housing 25. For ease of assembly of igniter 21, a port 37 is provided in the end surface 23 of housing 25 to permit escape of air trapped in housing 25 when container 51 is being inserted into housing 25 during manufacture of igniter 21. End surface 23 is generally planar and hence well-suited to be forcefully pressed or struck against a hard surface 101 (FIG. 5), thereby initiating ignition ("impact ignition"). Surface 23 substantially closes off the free or exposed end of igniter 21 except for port 37; moreover, port 37 is in turn closed off by the surface of container 51 which is opposite the membrane 53. Thus, port 37 does not necessarily have to be functional except during manufacture of igniter 21.

Although cotter pin 41 can be of various configurations, a very useful safety feature of cotter pin 41 shown in FIG. 2 is the contour 43 in the external half of pin 41, which contour engages the circular cross section of the outer surface of igniter housing 25 in a manner which impedes easy removal of cotter pin 41. Thus, removal of cotter pin 41 requires a deliberate act and would not happen by accident.

Cotter pin 41 fits snugly through a pair of polar (top and bottom) ports 33 that are in register. Pin 41 substantially blocks these ports while in place in the position shown in FIGS. 1 to 3, but another pair of equatorial or side ports 31 (also in register with each other) is always open, regardless of the position of cotter pin 41. (For operation of the igniter, only one port in housing 25 is normally needed, but top and bottom ports 33 for insertion of pin 41 are a particularly convenient and simple way to provide a plurality of ports during ignition.) Passageway 67 in striker 61 is partially but not totally blocked by cotter pin 41 when this pin is in place as shown in FIGS. 1 to 3.

The exact position of cotter pin 41 with respect to striker 61 and the passageway 67 in striker 61 is best understood from FIGS. 7 to 9, where it can be seen that cotter pin 41 fits snugly into a recess 64 between the split halves of cone-shaped awl 63. This recess is in communication with passageway 67, and passageway 67 provides communication between the recess and elongated space 27, because this passageway traverses the entire thickness of retainer disc 65 and awl 63. There can be leakage from passageway 67 around the circular cross-section of cotter pin 41 (especially upward and downward along pin 41) into the interior of igniter 21 and around awl 63; as a result there is communication between side ports 31 and elongated space 17 even when cotter pin 41 is in the position shown in FIGS. 1 to 3. However, this communication recess is not required for all versions of this embodiment. A flow of substantially pure oxygen through elongated space 17 to the membrane face of igniter 21 and out through ports 31 can therefore be established even before removing cotter pin 41, but the establishment of an oxygen flow prior to removal of pin 41 is not essential to operation of this invention.

After cotter pin 41 has been removed from igniter 21 altogether, the path of oxygen flow through the interior of igniter 21 can be understood from FIGS. 4 and FIGS. 7 to 9 by assuming that the pin 41 shown in phantom in FIGS. 7 to 9 has been removed. For example, efflux through the now-open ports 33 is completely unimpeded after cotter pin 41 has been removed.

As shown in FIG. 5, when planar surface 23 of the free or exposed end of igniter 21 is struck or butted up against hard, immovable vertical surface 101, and lance 11, preferably grasped at or near its oxygen-receiving end, is pressed sharply against retainer disc 65 in the direction of surface 101 (or is forced to move quickly in this direction by subjecting surface 23 to a sharp blow against surface 101), lance 11 acts like a piston rod driving "piston head" (striker) 61 directly into membrane 53, rupturing membrane 53 while, at the same instant, introducing an unimpeded, pressurized flow of substantially pure oxygen into intimate contact with the pyrophoric material 57 through passageway 67. Pyrophoric material 57, which is typically a mass of powder or a highly convoluted foil or a coating on a highly convoluted foil, has a very large surface area or porosity. The pressurized oxygen flows quickly over this large surface area and out through ports 31 and 33, via notches 66 in retainer disc 65 (FIGS. 5 through 9), virtually saturating material 57 with oxygen and causing material 57 to burst into flame. The pressurized flow of oxygen continues unabated, heating up the burning mass of material 57 to a temperature high enough to cause the material (preferably metal) in igniter 21 to burn, beginning with the material of container 51. As container 51 becomes consumed by the hot flame, the entire igniter 21 bursts into flame and ignites ignition end 19 of lance 11.

As used in this invention, the term "pyrophoric" means capable of generating hot sparks or bursting into flame upon coming into contact with air or oxygen, particularly when subjected to friction or compression in the presence of an oxygen-containing gas containing at least about 20 volume-% oxygen. Pyrophoric materials used in this invention are preferably solid rather than liquid and can be in the form of finely divided particles, large pellets, chunks, foils, films or coatings deposited on foils, or the like. Pyrophoric materials can be essentially inorganic (e.g. metallic), if desired.

Suitable inorganic pyrophoric materials containing a major amount of one or more metallic substances are known in the art and need not be described in detail. Certain types of three-dimensional solid or powdered metals are typically used for pyrophoric effects (where sparks or burning are produced generally spontaneously in an oxygen atmosphere, sometimes with an assist from friction of the type obtained in this invention by the sudden penetration of striker 61). There is even an alloy known as "pyrophoric alloy" or "sparking metal" or "Auer metal" which contains misch metal and about 30% by weight of other metals, chiefly iron. Even gentle friction can cause pyrophoric alloy to produce hot sparks. Thus, powdered pyrophoric metals typically include rare earths of the lanthanide and/or actinide series (e.g. La, Ce, Pr, Nd, Pm, Sm, U-238, and the like) or iron-cerium alloys, or unalloyed iron mixed with a rare earth, alone or in combination with light metals and light elements such as carbon, metallic aluminum, metallic calcium, silicon, or boron. Powdered magnesium also ignites fairly easily in oxygen and then burns with an extremely hot flame which provides temperatures well above the melting points and even the boiling points of many metals. It is important to note that light metals such as aluminum and magnesium do not necessary ignite easily when in the form of a monolithic mass such as a cast object, but they are relatively easy to ignite when in finely divided particulate form or in the form of a highly convoluted foil or a coating on a highly crumpled or convoluted foil exposed to a flow of substantially pure oxygen.

An advantage of a crumpled or convoluted foil over a powder is that some amount of powder may be blown out ports 33 or 31 when membrane 53 is punctured, but a foil will have a much greater tendency to remain confined to the interior of igniter 21.

Figures 17, 18, 19, 20, 21, 22, 23, 24, 25:
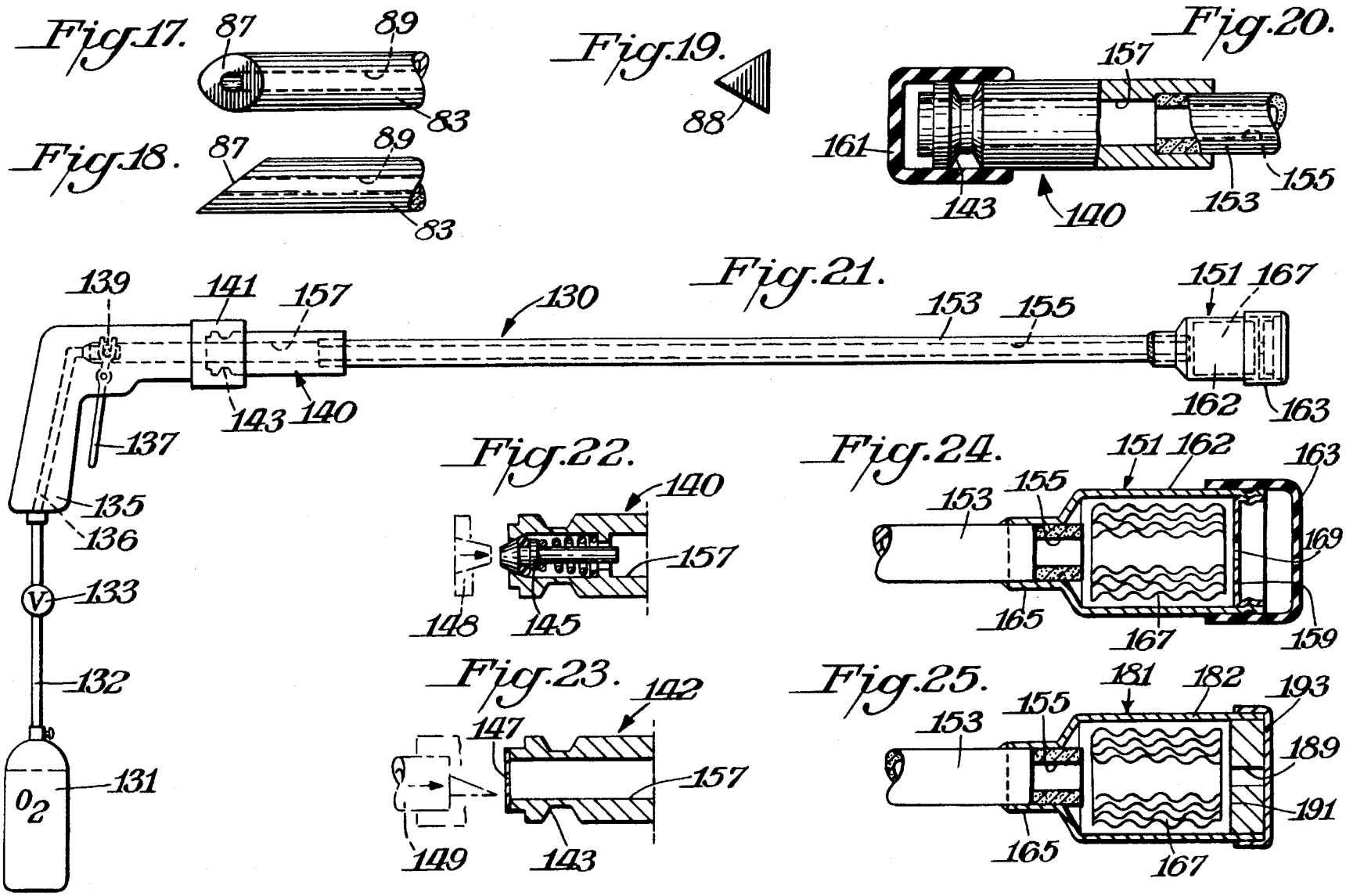
FIG. 17 is a fragmental top-plan view of a lance having an ignition end shaped to have a frusto-conical piercing face constructed and arranged to serve as a piercing tool.
FIG. 18 is a fragmental side-elevational view of the portion of the lance shown in FIG. 17.
FIG. 19 is top plan view of a separate piercing face placed in the igniter assembly.
FIG. 20 is a fragmental side elevational view partially broken away of a fitting for the oxygen-receiving end of a hollow lance showing a removable seal over the oxygen-receiving end of the fitting of the lance/igniter combination shown in FIG. 21.
FIG. 21 is a side elevational view of still another embodiment of a lance/igniter combination of this invention, showing a portable oxygen source and a control valve therefor.
FIG. 22 is a fragmental cross-sectional side-elevational view of a valved oxygen inlet of a fitting similar to the fitting shown in FIG. 20.
FIG. 23 is a cross-sectional view of a fitting similar to the fitting shown in FIG. 20 provided with a rupturable membrane seal.
FIG. 24 is an enlarged fragmental cross-sectional side-elevational view of one embodiment of the igniter portion of the lance/igniter combination shown in FIG. 21.
FIG. 25 is an enlarged fragmental cross-sectional side-elevational view of another embodiment of the igniter portion of the lance/igniter combination shown in FIG. 21.

FIGS. 10 to 19 relate to an alternate embodiment 80 of a lance/igniter combination wherein the igniter 81 is simpler in construction. The greater simplicity of construction of igniter 81 is made possible by the use of a lance 83 having an ignition end 87 with a profile providing cutting or puncturing capabilities or which is integral with a cutting or puncturing element. As shown in FIGS. 12, 14, 17, and 18, a particularly simple way to make the cutting tool integral with ignition end 87 is to shape this end 87 such that it tapers to a point or toward a point (see FIGS. 12 and 14) or so that it has a frusto-conical piercing face 87 (FIGS. 17 and 18) or a triangular piercing face 88 (FIG. 19). As shown, for example, in FIG. 15, even a flat profile is operative for rupturing a membrane, although more force is required in that case.

Figure 6:
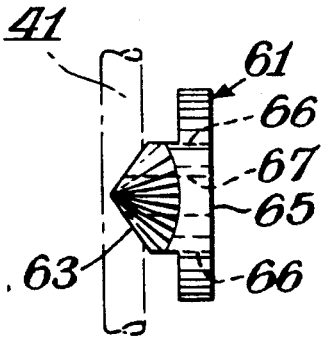
FIG. 6 is a side elevational view of the membrane penetration means.

In FIGS. 10 to 16, the function and even the construction of pin 41, ports 33 and 31, pyrophoric material 57, and container 51 is substantially the same as in FIGS. 1 to 5, hence these parts have been designated by the same reference numerals and will not be discussed in detail. The elongated space 89 within lance 83 (FIGS. 12, 14, 17, and 18) serves substantially the same function as elongated space 17 (FIGS. 3 and 5), except that, in addition, it also serves as a direct passageway into the interior of igniter for the flow of oxygen gas (cf. passageway 67 of FIGS. 5 to 8). Housing 85 is similar in construction and function to housing 25 (FIGS. 1 to 3 and 5), except that the free end 93 of housing 85 is substantially open and permits the end of container 51 to extend beyond free end 93 (best seen in FIGS. 12 and 14). Thus, when the free end of igniter 81 is forcefully contacted with a hard surface, by analogy to the impact-initiated ignition illustrated in FIG. 5, the container 51 moves like a piston toward the cutting or puncturing end 87 of lance 83 (compare FIGS. 12 and 14), thereby functioning much like a reverse-direction version of retainer disc 65 (FIGS. 3, 6, and 9). The structure and function of oxygen supply connector 141 is essentially the same as that of FIG. 21 and hence is discussed in detail in connection with the description of that Figure, below.

As an extra safety feature, the lance/igniter combination 80 is provided with detents to reduce further the possibility of unwanted or premature movement of the lance 83 toward the membrane 53 which isolates or seals off the pyrophoric material 57 from contact with air or oxygen. These detents comprise crimps 107 in a reduced-diameter opening or neck 95 of igniter housing 85 and recesses 105 in closely spaced relation to the ignition end 87 of lance 83. The boss-like protrusions of crimps 107 on the interior of neck 95 engage recesses 105, thereby providing the detent effect which minimizes unwanted movement, and when the free end of igniter 81 is forcefully contacted with unyielding surface 101 (as in FIG. 5), the piston-like movement of container 51 toward end 87 of lance 83 substantially eliminates any need for any movement of lance 83 in the opposite direction, thereby, as indicated earlier, simplifying the design of the membrane-penetrating or membrane-rupturing feature of an igniter of this invention.

Figure 14:
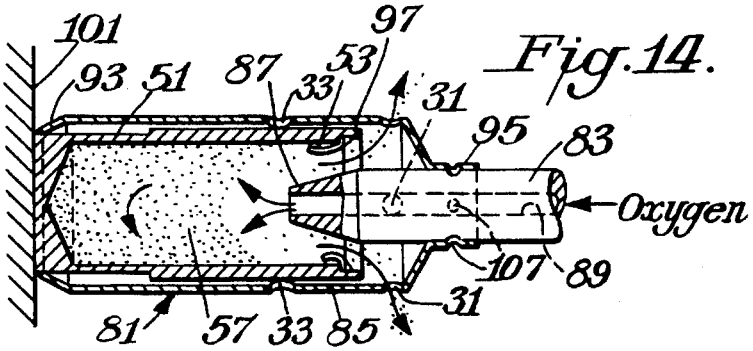
FIG. 14 is a cross-sectional view similar to FIG. 12 with the barrier means removed and showing membrane penetration and ignition conditions.

After the membrane 53 has been penetrated, as shown in FIG. 14, oxygen can flow directly into the interior of container 51 and come into intimate contact with pyrophoric material 57. Excess oxygen flows out of igniter 81 through ports 31 and 33, and at least one port 31 is preferably provided in closely spaced relation to the end 87 of lance 83 to bleed off any excess oxygen pressure inside the elongated space 89 within lance 83. Still another safety feature is provided by a small annular lip 97 which maintains a small spacing between membrane 53 and end 87, even after the removal of pin 41.

Figure 15:
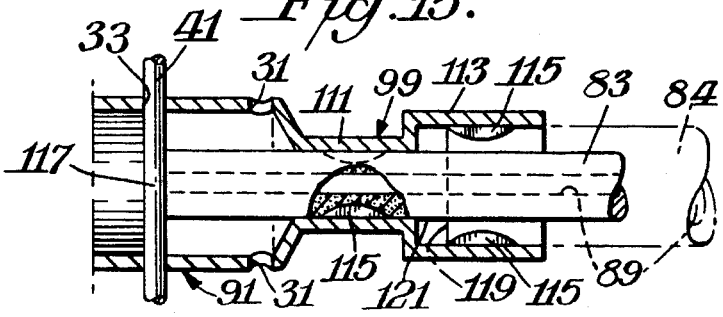
FIG. 15 is a side-elevational view of an igniter assembly which includes a dual size fitting for connection of the igniter assembly to lances of different diameters.
Figure 16:
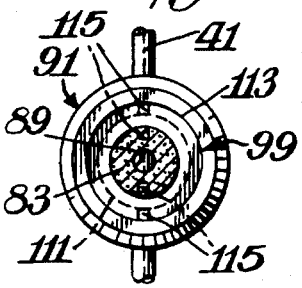
FIG. 16 is a right-end elevational view of the igniter assembly of FIG. 15.

Commercially available iron or steel thermal lances are not all of uniform outside diameter (they can range from as small as 3 or 4 mm to more than 10 mm), and it is desired that igniters of this invention be capable of accommodating two or more such outside diameters. In the embodiment of igniter 91 shown in FIG. 15, the igniter 91 is provided with a dual-size fitting 99 which includes a small-diameter neck or sleeve 111 and a larger-diameter neck or sleeve 113. When the lance which is to be attached to igniter 81 has a relatively small diameter, as in the case of lance 83, it can be inserted all the way through dual-size fitting 99 until it comes into contact with pin 41. As shown in FIG. 15, the flat profile of the end of lance 83 can be used to rupture membrane 53 (not shown in FIG. 15, but see FIG. 14 for an illustration of membrane penetration), although additional force is needed to break through the membrane as compared to the lance 83 with the more pointed end 87 (FIGS. 12, 14, 17, and 18).

Figure 10:
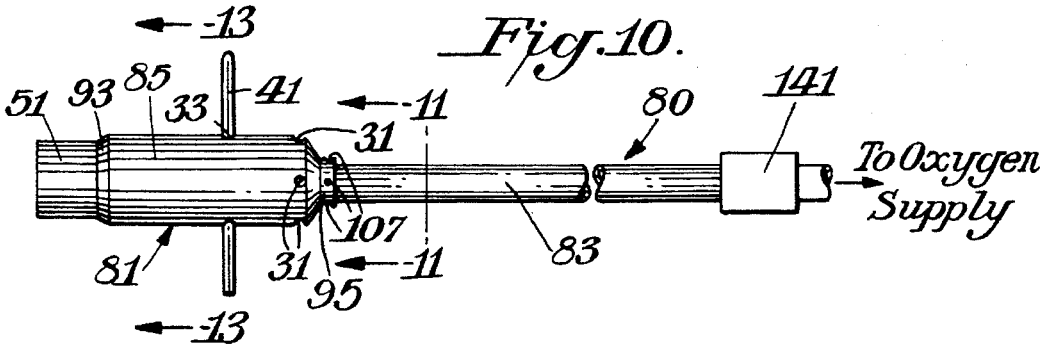
FIG. 10 is side-elevational view of another embodiment of a lance/igniter combination of this invention (where the igniter is attached to the end of the hollow lance)
Figure 11:
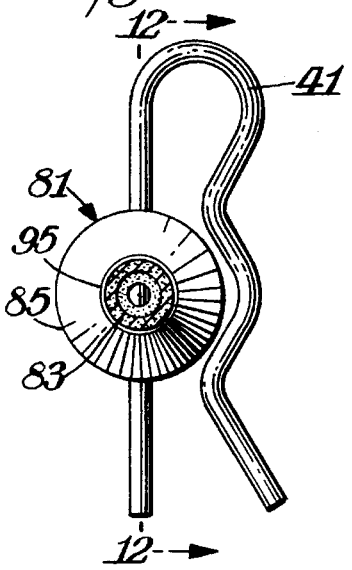
FIG. 11 is a cross-sectional end elevational view taking along line 11—11 of FIG. 10.
Figure 12:
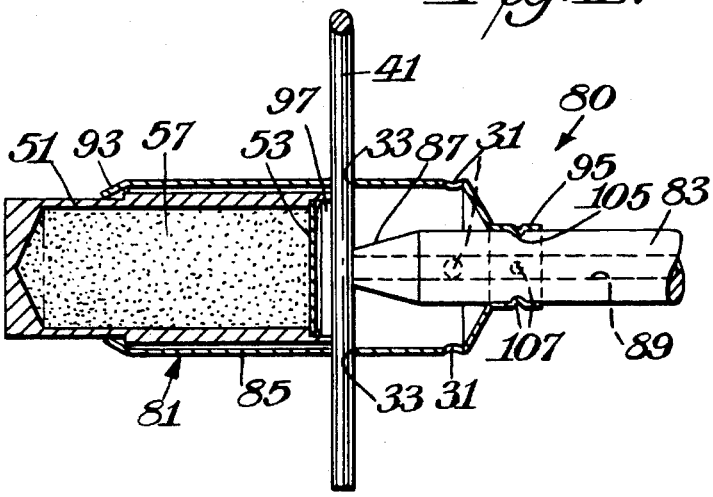
FIG. 12 is a cross-sectional side elevational view taken along line 12—12 of FIG. 11.
Figure 13:
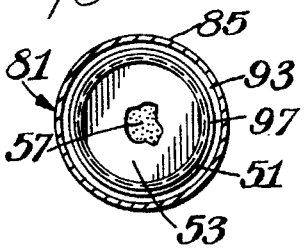
FIG. 13 is a cross-sectional end elevational view taking along line 13—13 of FIG. 10 and being partially broken away.

Interior bosses or protrusions 115 prevent unwanted movement of lance 83, as in the case of the detents (recesses 105 and crimps 107) described with respect to FIGS. 10, 12, and 14.

If the lance has a larger diameter, as in the case of lance 84 (shown in phantom outline), it can be inserted in the larger-diameter sleeve 113, where it is retained in place by interior bosses or protrusions 115, as in the case of lance 83. The ignition end of lance 84 is provided with a shoulder 119 to improve contact between this end of lance 84 and a removable reduced-diameter extension 121, inserted into small-diameter sleeve 111 only when the larger lance 84 is the size lance attached to igniter 91. The flat-profile end 117 of extension 121 provides rupture of the membrane (not shown in FIG. 15, but see, by analogy, FIG. 14) in the same manner as the end of lance 83, when the smaller type of lance is in use.

FIGS. 20 to 25 illustrate still another embodiment of a lance/igniter combination 130. FIG. 21 illustrates an essentially completely self-contained lance/igniter combination which includes a portable oxygen supply tank 131 and oxygen conduit 132, a regulator valve 133 for controlling the oxygen pressure, a pistol-grip type of handle 135 provided with an internal passageway 136 for flow-through of oxygen, a release valve 139 for releasing oxygen flow into an adapter/sealing fitting or connector 141 which protects against entry of air or water or moisture into the interior of lance/igniter combination 130 and engages the male end 143 of an oxygen-receiving fitting 140 which in turn engages lance 153, and finally, of course, an igniter device 151 attached to lance 153. The interior of fitting 140 is hollow, so as to provide a passageway 157 for the flow of oxygen which communicates with the elongated space 155 within lance 153. Lance 153 is attached to igniter 151 in generally the same manner that lance 83 is attached to igniter 81, and the elongated space 155 within lance 153 is exactly analogous to space 89 within lance 83 of, for example, FIG. 12. A pull or squeeze of trigger 137 actuates release valve 139, permitting oxygen to flow into connector 141. Since trigger 137 is normally urged toward the closed position, relaxation of that pull or squeeze causes valve 139 to close, shutting off the flow of oxygen. Connector 141 is preferably integral with handle 135, and its primary purpose is to provide a female connection for the male end 143 of oxygen-receiving fitting 140. In addition, connector 141 can provide a hollow actuating member 148 or 149 (FIGS. 22 and 23) for establishing communication between passageway 136 and the passageway 157 within fitting 140 (or its alternative embodiment, fitting 142).

Accidental ignition of the pyrophoric material 167 contained in the interior of igniter 151 is prevented by the trigger/release valve (137/139) arrangement described above, hence a pin or similar barrier means has been omitted from the igniter assembly 151, but it is, of course, within the scope of this invention to provide igniter 151 with a pin similar to pin 41 (see, for example, FIG. 12) as an extra safety measure.

A particularly preferred additional safety feature is provided at the male end 143 of fitting 140. This male-end feature can be embodied in various ways, as shown, for example, in FIGS. 22 and 23. Spring-loaded valve 145 (FIG. 22) is urged toward the closed position by its spring unless and until it is actuated (forced toward the open position by application of force sufficient to overcome the tension imposed by the spring) by actuating member 148, contained within connector 141 (but shown only in FIG. 22), the actuating member 148 being advanced by a squeeze of or pull upon trigger 137. Relaxation of the pull or squeeze of trigger 137 causes spring-loaded valve 145 to return to the closed position.

In the alternative embodiment shown in FIG. 23, an exactly analogous actuating member 149 is constructed to function as a piercing tool and pierces a membrane 147 which seals off the ingress to male end 143 of fitting 142. In this embodiment, relaxation of the pull or squeeze of trigger 137 shuts off the flow of oxygen to fitting 142, but the male end of fitting 142 remains open, the membrane 147 having been rendered incapable of preventing oxygen flow after piercing of this membrane 147 by actuating member 149.

Regardless of which male-end feature is employed, it is generally desirable to protect the male end 143 of fitting 140 prior to engagement with connector 141. A temporary (i.e. removable) elastomeric cap seal 161 (plasticized vinyl is adequate as the elastomeric material, but natural rubber, butadiene-styrene rubber, etc. can also be used) is provided for this purpose and is shown in FIG. 20.

Igniter 151 is illustrated in detail in FIG. 24, and an alternative embodiment of igniter 151, i.e. igniter 181, is shown in FIG. 25. In both of these igniter embodiments, lance 153 fits snugly into a neck 165 (similar to neck 95 of FIGS. 12 and 14). The interior of neck 165 communicates with the interior of the body or shell 162 of igniter 151 (FIG. 24), corresponding to the body or shell 182 of igniter 181 (FIG. 25). In the embodiments shown in FIGS. 24 and 25, no membrane blocks communication between elongated space 155 within lance 153 (although it is within the scope of this invention to provide such a membrane, by analogy to the structure shown, for example, in FIG. 12). Accordingly, when the oxygen flow has been initiated by pulling or squeezing trigger 137, the substantially pure oxygen gas flows, unimpeded, into the interior of igniter 151 (FIG. 24) or igniter 181 (FIG. 25) and comes into intimate contact with pyrophoric material 167 (FIGS. 24 and 25), causing it to ignite. The amount of pyrophoric material 167 (FIGS. 24 and 25) is sufficient to provide a hot flame for a period of seconds, typically for at least about 5 or 10 seconds, but burning times longer than 30 to 60 seconds are ordinarily unnecessary. It is preferred that the pyrophoric material 167 in these embodiments be in the form of sheet-like strips having a generally corrugated shape to provide integrity of material (so that pyrophoric particles will not be expelled from the interior of igniter 151 or 181) without sacrificing the large surface area needed for efficient ignition and rapid burning.

In the embodiment shown in FIG. 24, a port 169 for the escape of excess oxygen gas is provided in an otherwise closed end 159 of igniter 151. A discardible or destructible cap seal 163 excludes air and moisture (or water) from the interior of igniter 151 and hence from contact with pyrophoric material 167.

In the embodiment shown in FIG. 25, a different air/water sealing arrangement 193 is shown covering end 191 of igniter 181; in this case cap seal 193 is metallic and burns off after ignition, but the port 189 functions similarly to port 169 of FIG. 24.

FIGS. 26 to 30 illustrate the structure and use of a type of igniter 201 which can, if desired, be stored separately from the lance/handle arrangement 130/135 shown in FIG. 21 and which need not be firmly attached to the ignition end of lance 131; thus, when igniter 201 is to be used, no igniter device is attached to lance 130. On the other hand, except for the removal of an attached igniter and a sharpening of end 227 at the ignition end of lance 130, the complete lance/handle structure shown in FIG. 30 (with its connected oxygen supply tank 131, oxygen conduit 132, regulator valve 133, connector 141, oxygen-receiving fitting 140, etc.) can be considered to be essentially identical to that of FIG. 21.

Igniter 201 is small enough so that several such igniters can be stored in a pocket or attached to a belt (e.g. a diver's belt). The amount of pyrophoric material 167 in the interior of igniter 201 is large enough to burn for several seconds, e.g. from about 10 to about 60 seconds, more preferably about 15 to 30 seconds. Burning times longer than 30 seconds are normally superfluous, since the burning time of lance 130 is typically about 30 seconds, and the purpose of a continuing ignition capability of igniter 201, beyond the very few seconds it would take to ignite lance 130, is to enable the user of lance 130 to reignite it in the event that it is prematurely extinguished, e.g. during a the performance of a cutting task carried out under water.

Figure 26:
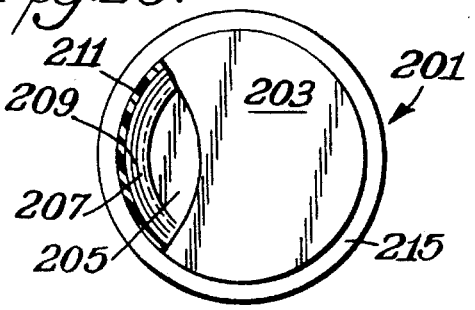
FIG. 26 is a top plan view partially broken away of another embodiment of an igniter device suitable for use in combination with a hollow lance.
Figure 27:
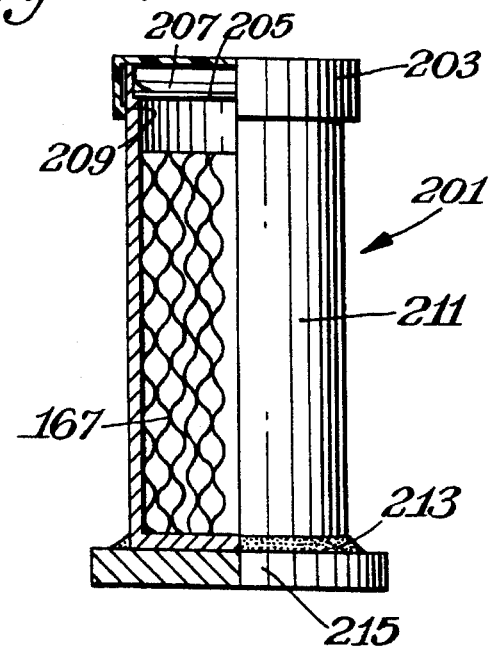
FIG. 27 is a side-elevational view, partially cut away, of the igniter device shown in FIG. 26.
Figure 30:
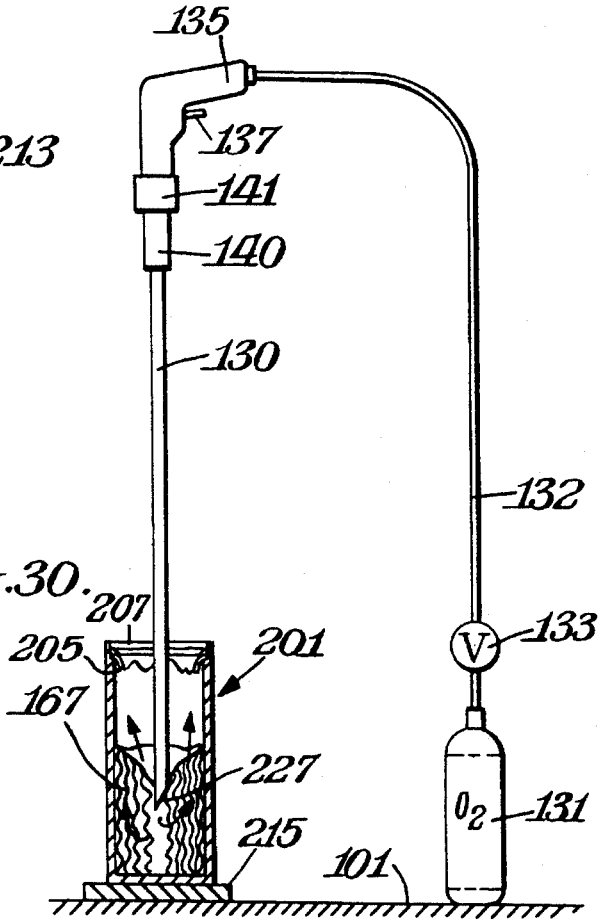
FIG. 30 is a side-elevational view partially in cross section showing a lance/igniter combination similar to the lance/igniter combination of FIG. 21.

The pyrophoric material 167 inside igniter 201 is protected from contact with air or water by shell 211, which is firmly attached by means of a weld 213 to base 215 (FIG. 27) and by rupturable membrane 205, sealed around the edges by adhesive seal 207 (FIGS. 26 and 27). To provide a barrier against accidental or premature rupture of membrane 205, a rupture-resistant or rupture-proof, removable protective cap or cover 203 protects membrane 205 and, notwithstanding its ability to be removed, also provides a further air-tight and water-tight seal, resulting from tight frictional engagement with annular bead 209 (FIGS. 26 and 27). To use igniter 201, cover 203 is removed, igniter 201 is placed on a firm, generally flat surface 101, and, as shown in FIG. 30, the sharpened tip or end 227 of lance 130 is forcefully plunged into the interior of igniter 201, breaking membrane 205 and exposing pyrophoric material 167 to a flow of substantially pure oxygen gas, causing material 167 to ignite.

Figure 28:
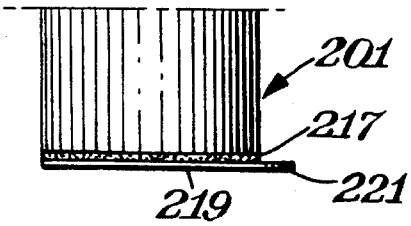
FIG. 28 is a fragmental side-elevational view of an igniter device similar to the igniter device shown in FIGS. 26 and 27 but having an adhesive-coated base for securing the device to a surface.
Figure 29:
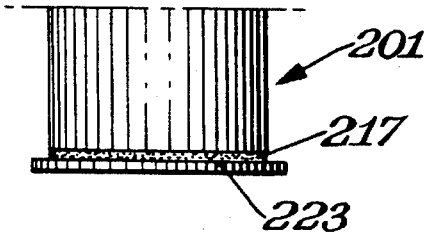
FIG. 29 is a fragmental side-elevational view of an igniter device similar to the igniter device shown in FIGS. 26 and 27 but having a magnetic base superposed upon an adhesive base for securing the device to a surface.

For stability in this mode of use, base 215 (FIG. 27) can be magnetized to provide a relatively firm (but still temporary) attachment to surface 101, if surface 101 is metallic. If surface 101 is not metallic, or if the presence of a magnetic field is undesirable, FIG. 28 illustrates an embodiment in which igniter 201 can be provided with a pressure-sensitive or water-activatable adhesive-coated adherent base 217 temporarily protected by a release liner 219 provided with a tab 221 to facilitate removal of liner 219. Alternatively, as shown in FIG. 29, igniter 201 can be provided with both an adhesive-coated base 217 and a removable magnetized base 223, the magnetized base 223 serving the same function as release liner 219. The base can also be made of high temperature plastic, fire brick, or other suitable material to provide a stable base which will not easily melt under the high temperatures associated with cutting rod ignition. A base made of other material can also be used in conjunction with a ceramic or metal inner cup; which would prevent the base from being destroyed during cutting rod ignition.

Figure 31:
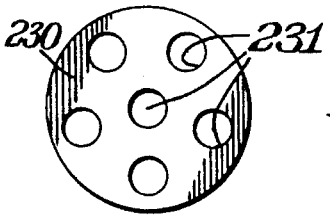
FIG. 31 is an end elevational view of a multi-bore hollow lance useful in the lance/igniter combinations of FIGS. 1, 10, and 21.

It will be understood that, although only a single elongated space (e.g. space 89 in FIG. 12) has been shown in the various embodiments of lances used in this invention (e.g. lance 83 of FIG. 12), any of these lances can be multi-bore structures, as shown in cross-section in FIG. 31, wherein the lance 230 has six bores 231.

The typical large oxygen tanks used to provide oxidizer for welding and cutting torches contain substantially pure oxygen under more than 1,000 pounds per square inch (>7 MPa) pressure, e.g. under about 5,000 p.s.i. (about 35 MPa). These tanks contain enough oxygen for several time-consuming cutting or welding tasks. An oxygen tank adequate for one or two small tasks would be much smaller and could easily be strapped onto the torch operator's back or hip. As is conventional in the art, the oxygen supply 131 (see FIGS. 21 and 30, is provided with a regulator 133 (also shown in FIGS. 21 and 30) to reduce the pressure to any desired level suitable for running a solid-fueled torch. In this invention, oxygen pressures ranging from about 10 to about 100 p.s.i. (about 70 to about 700 KPa) are typical, about 60 to about 80 p.s.i. (about 420 to about 560 KPa) being especially useful for heavy-duty cutting through thick concrete or steel.

Operation of the Invention

To operate a combination 10 (FIGS. 1 to 9) of this invention, the combination 10 can, if desired, be assembled just before use, in which case the ignition end 19 of lance 11, before or after the opposite end of lance 11 has been or will be attached to its oxygen supply, is inserted into fitting 27 and butted up against the exposed surface of disc 65. Before or after the flow of oxygen is begun, the barrier (cotter pin 41) is removed, and the igniter is activated as described above, thereby rupturing or puncturing membrane 53 and exposing the pyrophoric material 57 to the flow of oxygen. The ignition end 19 of the lance 11 is ignited by the rapid burning of the pyrophoric material. As lance 11 continues to burn, the entire igniter device 21 falls away from lance 11, leaving lance 11 ready for use. Lance 11 then becomes a torch, endogenous except for its oxygen supply, the hot flame provided at end 19 of lance 11 being excellent for cutting metal, concrete, or the like, even under water, where the flame is surrounded by a vast heat sink.

As explained previously, shutting off the oxygen supply extinguishes the torch flame and preserves whatever solid fuel is left in lance 11. The steps of the above-described operation can be repeated with a new igniter when reignition of lance 11 is appropriate.

Operation of the embodiments of FIGS. 10 to 19, FIGS. 20 to 25, and FIGS. 26 to 30 is generally analogous to the operation of the embodiments of FIGS. 1 to 9 and can be readily understood by comparing FIGS. 12 and 14 (in the case of the embodiment of FIGS. 10 to 19) or by considering the complete structure shown in FIG. 21 (in the case of the embodiment of FIGS. 20 to 25) or by considering the method of operation shown in FIG. 30 (in the case of the embodiment of FIGS. 26 to 30).

OTHER EMBODIMENTS

Of course, the combinations of lance and igniter illustrated in the accompanying Drawing can be modified in various ways. For example, the entire free end of the igniter device can be constructed and arranged to be removable during its manufacture, so that an air-tight container for the pyrophoric material can be inserted into the interior of the igniter from the free end rather than from the lance-engaging end of the igniter, thereby obviating any need for a port in the free end of the igniter of FIGS. 1 to 5. The number of ports in the igniter housing can be limited to one or two, if desired. As shown by FIGS. 26 to 30, the barrier means need not be a pin, so long as it protects the pyrophoric material container during underwater use and also from premature or undesired penetration. Other modifications will occur to those skilled in the art.

What is claimed is:

1. A thermal lance/igniter combination which is substantially self-contained, comprising:

an elongated, hollow metallic thermal lance defining an elongated interior space and having an oxygen-receiving end and an ignition end, the ignition end being moveable and removably attached to a substantially self-contained ignition device, said oxygen-receiving end including a means for introducing pressurized, substantially pure oxygen into said elongated space, said substantially self-contained ignition device comprising:

an igniter housing provided at one end with an opening, for receiving the ignition end of the lance and for permitting movement of said ignition end into the interior of the igniter housing, said ignition end being inserted in said opening, the opposite end of said housing being a free end, a removable barrier inserted in an opening in the igniter housing and in spaced relation to said free end of the housing, a sealed container disposed within the interior of the housing and extending from the barrier to at least as far as said free end of the housing and having an open side facing the elongated space defined by the lance, said container containing a pyrophoric composition, said open side being air-tightly sealed by an air-impermeable sealing membrane for protecting the pyrophoric composition from contact with the atmosphere, said ignition end being prevented from contacting said sealing membrane by the barrier but being arranged to actuate penetration of said sealing member upon removal of said barrier and upon moving said ignition end further into the interior of said housing, said pyrophoric composition being ignited, after removal of said barrier, by movement of said ignition end further into the interior of said housing and by penetration of the sealing membrane and flow-through of substantially pure oxygen via said elongated space into the interior of said housing.

2. The thermal lance/igniter combination according to claim 1, wherein said ignition end is arranged to actuate penetration of said sealing member upon removal of said barrier by placement of said ignition end in contact with a piercing tool having a passageway therein for permitting flow-through of substantially pure oxygen from said elongated space into the interior of said housing.

3. The lance/igniter combination according to claim 1, wherein the lance and the igniter housing are generally cylindrical in shape.

4. The lance/igniter combination according to claim 1, wherein the igniter housing has a plurality of vent ports to permit pressurized, substantially pure oxygen to exit from the interior of said housing via said vent ports.

5. The thermal lance/igniter combination according to claim 4, wherein said vent ports are arranged such that, after removal of said barrier and said movement of said ignition end further into the interior of said housing, with penetration of the sealing membrane, substantially pure oxygen can pass into intimate contact with said pyrophoric composition in said container in its path of flow to said vent ports.

6. The thermal lance/igniter combination according to claim 4, wherein said barrier is a removable pin in an inserted position, which position passes through at least one vent port in a tight-fitting relationship that substantially seals off said vent port until the pin is removed.

7. The thermal lance/igniter combination according to claim 6, wherein the number of vent ports in the igniter housing is greater than the number of ports sealed by off by said removable pin while the removable pin is in said inserted position.

8. The thermal lance/igniter combination according to claim 6, wherein said removable pin while in said inserted position passes through a pair of vent ports, said pair of vent ports being in register.

9. The thermal lance/igniter combination according to claim 1, wherein said ignition end is arranged to actuate penetration of said sealing member upon removal of said barrier by a piercing face integral with said ignition end.

10. The thermal lance/igniter combination according to claim 1, wherein the thermal lance comprises a ferrous metal.

11. The thermal lance/igniter combination according to claim 1, wherein said combination includes a portable oxygen supply.

12. An ignition device constructed and arranged to be removably attached to one end of a thermal lance, said ignition device comprising:

a housing provided at one end with an opening, for receiving an end of a thermal lance and for permitting movement of the end of the thermal lance into the interior of the housing, the opposite end of said housing being a free end, a removable barrier inserted in an opening in the igniter housing and in spaced relation to said free end of the housing, a sealed container disposed within the interior of the housing extending from said barrier to at least as far as said free end of said housing and having an open side facing the said opening, said container containing a pyrophoric composition, said open side being air-tightly sealed by an air-impermeable sealing membrane for protecting the pyrophoric composition from contact with the atmosphere, said pyrophoric composition being ignited, after removal of said barrier, by rupture of the sealing membrane and by flow-through of substantially pure oxygen into said container.

13. The ignition device according to claim 12, wherein said membrane penetration means comprises a piercing tool in contact with said barrier.

14. The ignition device according to claim 12, wherein the igniter housing has a plurality of vent ports to permit pressurized gas to exit from the interior of said housing via said vent ports.

15. The ignition device according to claim 14, wherein said barrier means is a removable pin in an inserted position, which position passes through at least one vent port in a tight-fitting relationship that substantially seals off said vent port until the pin is removed.

16. An ignition device constructed and arranged to be removably attached to one end of a thermal lance, said ignition device comprising:

a shell having an open end for receiving an end of a thermal lance and for permitting movement of the end of the thermal lance into the interior of the shell, the opposite end of said shell being a closed end, a rupturable, air-impermeable membrane air-tightly sealing off said open end and preventing atmospheric oxygen from entering said shell, the interior of said shell being substantially oxygen free, a plurality of solid, generally foil strips consisting essentially of pyrophoric material disposed within the interior of said shell, the total amount of pyrophoric material disposed within the interior of said shell, when ignited with substantially pure oxygen, being sufficient to burn for about 10 to about 60 seconds, said pyrophoric composition being ignited, after rupture of the air-impermeable membrane, by flow-through of substantially pure oxygen through said open end into the interior of said shell.

17. An ignition device according to claim 16, wherein a rupture-resistant protective cover engages the open end of said shell to prevent accidental rupture of said air-impermeable membrane.

18. An ignition device according to claim 17, wherein the closed end of said shell includes an attaching means for attaching said closed end to a generally flat surface.

19. A method for igniting an igniter for a hollow thermal lance combustible with substantially pure oxygen, said method comprising:

providing the igniter with sufficient pyrophoric foil strips to burn in substantially pure oxygen for about 10 to about 60 seconds and sealing off the pyrophoric foil strips from the atmosphere in a substantially oxygen-free zone by means of a rupturable, air-impermeable membrane, protecting said membrane from accidental rupture by means of a protective element, attaching the igniter to a first end of said thermal lance, leaving the opposite, free end available to receive a flow of substantially pure oxygen, removing the protective element, introducing a flow of substantially pure oxygen into the interior of the thermal lance through said free end, and rupturing said rupturable, air-impermeable membrane with said first end of said thermal lance, so that said flow of substantially pure oxygen can enter said substantially oxygen-free zone.

20. A method according to claim 19, wherein said protective element is a removable barrier.

* * * * *